United States Patent [19]

Kuypers et al.

[11] Patent Number: 4,858,538

[45] Date of Patent: Aug. 22, 1989

[54] PARTIAL COMBUSTION BURNER

[75] Inventors: Willem F. Kuypers; Hendrikus J. A. Hasenack, both of Amsterdam, Netherlands

[73] Assignee: Shell Oil Company, Houston, Tex.

[21] Appl. No.: 207,471

[22] Filed: Jun. 16, 1988

[51] Int. Cl.[4] ..... F23D 1/02

[52] U.S. Cl. ..... 110/264; 239/132.3; 110/263

[58] Field of Search ..... 431/160, 181, 187, 254; 110/263; 48/DIG. 7, 197 R, 202, 203, 210, 56 R; 239/132, 132.1, 132.3, 422, 423, 424, 433, 434.5

[56] References Cited

U.S. PATENT DOCUMENTS

| | | | |
|---|---|---|---|
| 3,101,384 | 8/1963 | Metz | 239/132.3 |
| 3,224,679 | 12/1965 | Kear et al. | 239/132.3 |
| 3,567,202 | 3/1971 | Mercatoris et al. | 239/132.3 |
| 4,350,103 | 9/1982 | Poll | 110/264 |
| 4,510,874 | 4/1985 | Hasenack | 110/347 |
| 4,519,321 | 5/1985 | Poll et al. | 110/263 |
| 4,523,529 | 6/1985 | Poll | 110/263 |
| 4,666,397 | 5/1987 | Wenning et al. | 431/160 |

*Primary Examiner*—Randall L. Green
*Attorney, Agent, or Firm*—Ronald R. Reper

[57] ABSTRACT

Disclosed is a burner for the partial combustion of a solid carbonaceous fuel, and suitable for use in an reactor having a plurality of burners wherein e.g. finely divided coal is supplied to a reactor space via a central channel disposed along the longitudinal axis of the burner, and oxygen-containing gas is supplied via an annular channel surrounding said central channel and configured for said gas to intersect said coal at an acute angle, and heat from the combustion is removed from a dimensioned curvilinear hollow front of the burner by coolant flowed radially at constant momentum through said hollow front.

5 Claims, 1 Drawing Sheet

PARTIAL COMBUSTION BURNER

BACKGROUND OF THE INVENTION

The invention relates to a burner for use in the partial combustion of carbonaceous fuels, and particularly for the partial combustion of finely divided solid fuel such as pulverized coal, in which the fuel is introduced together with an oxygen-containing gas into a reactor space operating under elevated pressure up to 100 bar for producing pressurized synthesis gas, fuel gas or reducing gas.

Partial combustion, also known as gasification, of a solid carbonaceous fuel is obtained by the reaction of the fuel with oxygen. The fuel contains as combustible components, mainly carbon and hydrogen, which react with the supplied oxygen (and possibly with any steam and carbon dioxide as may be present) to form carbon monoxide and hydrogen. At some temperatures it is also possible to form methane.

There are at least two different processes for the partial combustion of solid fuel. In the first process, solid fuel in particulate form is contacted with an oxygen-containing gas in the reactor in a fixed or fluidized bed at a temperature below about 1000C. A drawback of this method is that not all types of solid fuel can be partially combusted in this manner. For example, high swelling coal is unsuitable since particles of such coal type easily sinter, resulting in risk of clogging of the reactor.

A more advantageous process passes the finely divided fuel in a carrier gas such as nitrogen or synthesis gas into a reactor at relatively high velocity. In the reactor a flame is maintained in which the fuel reacts with oxygen-containing gas at temperatures above 1000C. The carbonaceous fuel is usually passed into the reactor via a burner, and the oxygen-containing gas is also passed via the burner into the reactor. In some processes a moderator gas such as steam or carbon dioxide is admixed with the oxygen-containing gas passed via the burner to the reactor; such a moderator gas is often advantageous for reducing or preventing premature contact of the oxygen with the reactor gas, which might result in undesirable complete conversion of the reactor gas.

The present burner is well suited to introduce the reactants horizontally into the reaction zone of a conventional, refractory lined partial oxidation gas generator, also referred to herein as a reactor, or gasification apparatus. It is particularly suited for use in solid fuel gasification apparatus having a plurality of burners for the reactants positioned on the periphery of the combustion zone, whereby the burner jets impinge on or near each other to facilitate the partial oxidation process and to minimize erosion of the refractory wall.

Since flame temperatures may exceed 3000° C. or more, a primary concern of such burners is to prevent damage to the burner front, also referred to as the burner face, caused by the high heat flux and the potentially corrosive environment during the gasification process. To protect the burner front from overheating, it is conventional to provide a refractory lining applied to the outer surface of the burner front wall and/or provide a hollow wall member with internal cooling passages through which cooling fluid is circulated at a rapid rate. The present invention provides an improved burner having an internal structure wherein the cooling fluid is caused to flow in a particular manner to assure against possible high corrosion rates and to obtain even cooling over the burner front so as to minimize thermal stresses all of which could cause deterioration and even failure of the burner during prolonged operation.

A further advantage of the present burner configuration is the smooth curvilinear burner face dimensioned so as to facilitate durability in the presence of the corrosive atmosphere and heat flux resulting from the gasification reaction. The curvilinear front enables the burner front face construction to be relatively flexible, whereby it can withstand relatively high local heat flux without developing local thermal stress which could lead to failure.

SUMMARY OF THE INVENTION

In accordance with the invention there is provided a burner for the partial combustion of finely divided solid carbonaceous fuel with an oxygen-containing gas in a combustion zone, said burner having a supply end and a discharge end and comprising:

a central channnel disposed along a longitudinal axis of the burner and having an outlet at the discharge end of the burner for supplying fuel to the combustion zone;

a substantially annular channel disposed coaxially with said central channel and having an outlet with a diameter D, at the discharge end of the burner and configured to supply oxygencontaining gas flow to the combustion zone at an acute angle with respect to said longitudinal axis for directing said supplied oxygen to intersect the fuel supplied from said central channel;

a hollow wall member disposed at the discharge end of said burner and coaxially with said substantially annular channel and having a central aperture through which said fuel and said oxygen-containing gas flow to the combustion zone; at said discharge end said hollow wall member having a curvilinear outer surface including an arcuate shape substantially normal to the longitudinal axis of the burner extending from the outlet of said substantially annular channel to the lateral dimension of the burner, said hollow wall member at the lateral periphery of the burner extending from said discharge end of the burner toward the supply end of the burner for a distance of at least one-half D, said hollow wall member having an internal construction of substantially uniform cross-sectional flow area in a radial direction; said hollow wall member being operatively connected to: (a) a supply conduit disposed adjacent to said substantially annular channel to supply fluid coolant to a proximate first end of said hollow all member and (b) a return conduit disposed to pass fluid coolant proximately from the other end of said hollow wall member, whereby fluid coolant flows outwardly and substantially radially through said hollow wall member from said supply conduit; said hollow wall member being dimensioned for substantially constant momentum of coolant flow therethrough.

The invention provides a burner that is capable of operation for extended periods of time without subjecting the discharge end and other burner components to excessive metal temperature and/or stress.

BRIEF DESCRIPTION OF THE DRAWINGS

The invention will now be described in more detail, by way of example only, with reference to the accompanying drawings, wherein.

DESCRIPTION OF PREFERRED EMBODIMENTS

Figure 1:
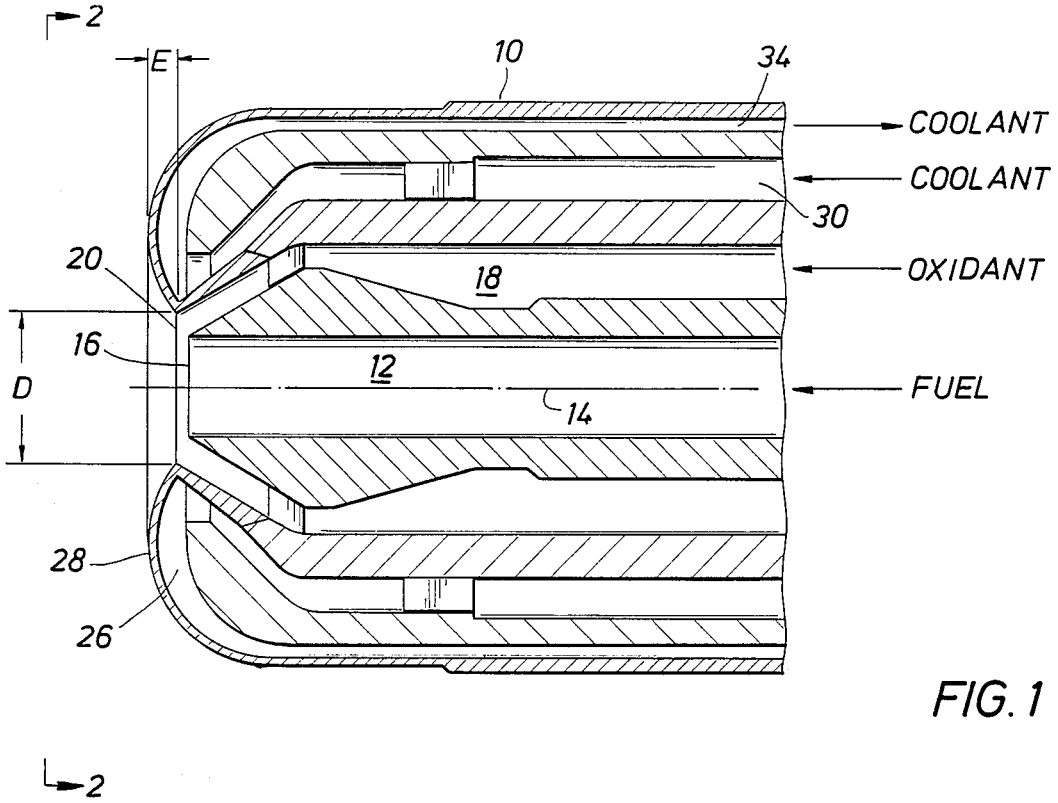
FIG. 1 is a longitudinal section of the front part, including the discharge end, of a burner according to the invention.

It should be noted that identical elements shown in the drawings have been indicated with the same reference numeral.

Figure 2:
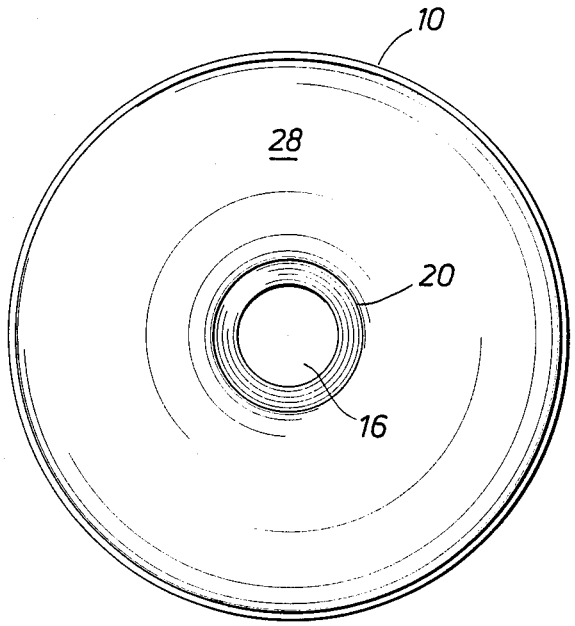
FIG. 2 shows a cross-Section of 2—2 of FIG. 1.

Referring to FIGS. 1 and 2, a burner, generally indicated with the reference numeral 10, for the partial combustion of a carbonaceous fuel, such as pulverized coal comprises central channel 12 disposed along longitudinal axis 14, and having a discharge outlet 16 for supplying a finely divided solid fuel in a carrier gas, e.g. nitrogen or synthesis gas, to a downstream combustion zone (not shown). The central channel generally will have a diameter in the range from about 10 to about 50 mm. Concentrically arranged around the central channel 12 is substantially annular channel 18 for oxygen-containing gas having free end 20 of a diameter D forming an outlet for the oxygen-containing gas flow into the combustion zone. Preferably outlet 20 is disposed at an angle of from about 20 to about 60 degrees with respect to the longitudinal axis 14 so that the issuing stream of oxygen-containing gas will intersect and mix with the stream of solid fuel issuing from outlet 16. The outlet 20, having a diameter, D forms the throat or narrowest section of the nozzle of the burner. The oxygen-containing gas, may, if desired contain a moderator gas such as e.g. steam or carbon dioxide. Conventional separators are used for radially spacing the channels from each other, for example alignment pins, fins, centering vanes, spacers and other conventional means are used to symmetrically space the channels with respect to each other and to hold same in stable alignment with minimal obstruction to the free flow of the reactant streams.

The burner 10 further comprises a hollow wall member 26 having a curvilinear, preferably toroidal, outer surface forming a front face 28 which is generally normal to the longitudinal axis 14 of the burner and an annular cylindrical part extending parallel to said longitudinal axis toward the supply end of the burner. The hollow wall member will have a uniform cross-sectional flow area extending from the front face i.e. discharge end of the burner toward the supply end of the buner and generally parallel to the longitudinal axis for a distance of at least about 0.5 D, preferably at least about D, and most preferably from about 2 to about 10 D. The hollow wall member is at the centermost end operatively connected to supply conduit 30 for supplying liquid coolant such as tempered water to said hollow wall member and having the other end of said hollow wall passage, disposed at the periphery of the burner operatively connected to return conduit 34 to pass liquid coolant from said hollow wall passage. When water is used as coolant it is supplied to the hollow wall member at a flow rate sufficiently high that at maximum heat output of the burner the water entering the return conduit will have increased no more than about 5 degrees C, and preferably less than about 3 degrees C. It is found advantageous to employ as coolant tempered water having a temperature in the range from about 100 to about 230 degrees C.

Preferably the curvilinear end of the burner will extend downstream of the throat, but a short distance, E, which distance will ordinarily be e.g. less than about 2D and more preferably from about 0.2 to about 1D from the end of the substantially annular passage in order to prevent of reduce premature combustion as may occur with some more reactive feeds.

It is an advantage of the present invention that it permits convective heat transfer from combustion of the reactants downstream of the burner face while avoiding, substantially or altogether, boiling of the coolant liquid within the hollow wall member. The use of the substantially constant cross-sectional area hollow wall member assures constant momentum of the coolant liquid enabling even, low metal temperature in the burner face and discharge end.

A further advantage is the overall mechanical structure tolerant to asymmetric heat fluxes as may occur in some gasifier configurations employing a plurality of burners.

During operation of the above described burner 10 for the gasification of carbonaceous fuel, e.g. pulverized coal by means of oxygen-containing gas, said coal suspended in a carrier fluid such as nitrogen or synthesis gas is passed through the central channel 12 to outlet 16 for introducing the coal into the combustion zone of a reactor arranged downstream of the discharge end of the burner. Simultaneously, oxygen-containing gas is passed through annular channel 18 to outlet 20 so that the coal and oxygen-containing gas reactants will be intensively mixed in the reactor space. If desired the mixing of the reactants can be further promoted by a swirling motion imparted to one or both streams by a swirl body of baffles (not shown) in the appropriate channel. To promote stable outflow of coal the cross sectional area available for the coal flow should be kept constant over at least part of the burner near the outlet.

The rate of flow for the flow of pulverized fuel in carrier gas is controlled. The burner firing rate, i.e. turnup or turndown of the burner is effected by changing the flow rate for each of the carbonaceous fuel and oxygen-containing gas feed-streams while maintaining a substantially constant ratio of atomic oxygen to carbon in the solid feed. Generally an oxygen demand of 0.9 to 1 ton per ton of moisture and ash-free coal is fairly typical of hard coals; for low rank coals 0.7 tons oxygen per ton is more representative. It is preferred to operate by supplying oxygen-containing gas at a mean velocity in the range from about 35 to about 100 meters/second.

The burner will ordinarily be fabricated of high temperature resistant materials, particularly high temperature resistant metals and alloys such as Inconel and/or ceramics. For high duty operations the channel and outlet for the oxygencontaining gas, which are usually made of metal, and may be internally coated with an oxydic coating, such as $ZrO_2$, or a ceramic, enabling the application of high oxygen-containing gas velocities without the risk of metal combustion by the oxygen.

The term solid carbonaceous fuel as used herein is intended to include various materials and mixtures thereof from the group of coal, coke from coal, coal liquefaction residues, petroleum coke, soot, and particulate solids derived from oil shale, tar sands and pitch. The coal may be of any type, including lignite, subbituminous, bituminous and anthracite. The solid carbonaceous fuels are preferably ground to a particle size so that 90% of the material is less than 90 microns and the moisture content is less than about five per cent weight.

The term oxygen-containing gas as used herein is intended to include air, oxyen-enriched air, i.e. greater than 21% mole oxygen, and also substantially pure oxygen, i.e. greater than about 95% mole oxygen, with the remainder comprising gases normally found in air such as nitrogen and the rare gases.

What is claimed is:

1. A burner for the partial combustion of finely divided solid carbonaceous fuel with a an oxygen-containing gas in a combustion zone, said burner having a supply end and a discharge end and comprising:

a central channel disposed along a longitudinal axis of the burner and having an outlet at the discharge end of the burner for supplying fuel to the combustion zone;

a substantially annular channel disposed coaxially with said central channel and having an outlet forming the throat of the burner with a diameter D, at the discharge end of the burner and configured to supply oxygen-containing gas flow to intersect the fuel from said central channel;

a hollow wall member disposed at the discharge end of said burner and coaxially with said substantially annular channel, said hollow wall member having a construction defining an internal passage for fluid coolant, said passage having a first end adjacent to said substantially annular channel and another end adjacent to the lateral periphery of the burner at said discharge end said hollow wall member having a curvilinear outer surface including an arcuate shape substantially normal to the longitudinal axis of the burner extending from the outlet of said substantially annular channel to the lateral dimension of the burner, said curvilinear outer surface extending in the downstream direction of said throat a distance from about 0.2 to about 1 D, said hollow wall member at the lateral periphery of the burner extending from said discharge end of the burner toward the supply end of the burner for a distance of at least one-half D, said hollow wall member internal passage being of substantially uniform cross-sectional area in a radial direction; said hollow wall member being operatively connected to: (a) a supply conduit disposed adjacent to said substantially annular channel to supply fluid coolant to a proximate first end of said hollow wall member and (b) a return conduit disposed to pass fluid coolant proximately from the other end of said hollow wall member whereby fluid coolant flows outwardly and substantially radially through said hollow wall member from said supply conduit; said hollow wall member being dimensioned for substantially constant momentum of coolant flow therethrough.

2. The burner of claim 1 wherein said substantially annular channel is configured to supply oxygen-containing gas at an acute angle of 20 to 60 degrees with respect to the longitudinal axis of the burner.

3. The burner of claim 1 wherein said central channel has a diameter of 10–50 mm.

4. The burner of claim 1 wherein the hollow wall member is of uniform cross-sectional area extending from the discharge end of the burner toward the supply end of the burner and generally parallel to the longitudinal axis for a distance of at least about D.

5. The burner of claim 4 wherein said uniform cross-sectional area extends from the discharge end of the burner for a distance of within the range from about 2 to about 10 D.

* * * * *